US010098518B2

(12) United States Patent
Xu et al.

(10) Patent No.: US 10,098,518 B2
(45) Date of Patent: Oct. 16, 2018

(54) ROTATING SPRAY WALL USED IN WASHING APPARTUS AND APPLICATION THEREOF

(71) Applicant: NINGBO FOTILE KITCHEN WARE CO., LTD, Ningbo (CN)

(72) Inventors: Hui Xu, Cixi (CN); Yangzhong Lian, Cixi (CN); Dengguang Zhu, Cixi (CN); Feng Zheng, Cixi (CN); Shuai Li, Cixi (CN); Zhongqun Mao, Cixi (CN); Yongding Zhu, Cixi (CN)

(73) Assignee: Ningbo Fotile Kitchen Ware Co., Ltd., Ningbo (CN)

( * ) Notice: Subject to any disclaimer, the term of this patent is extended or adjusted under 35 U.S.C. 154(b) by 132 days.

(21) Appl. No.: 15/109,323

(22) PCT Filed: Dec. 22, 2014

(86) PCT No.: PCT/CN2014/001153

§ 371 (c)(1),
(2) Date: Jun. 30, 2016

(87) PCT Pub. No.: WO2015/100699

PCT Pub. Date: Jul. 9, 2015

(65) Prior Publication Data

US 2016/0324393 A1 Nov. 10, 2016

(30) Foreign Application Priority Data

Dec. 31, 2013 (CN) ..... 2013 1 0752116

(51) Int. Cl.
*A47L 15/00* (2006.01)
*A47L 15/22* (2006.01)

(52) U.S. Cl.
CPC ..... *A47L 15/0086* (2013.01); *A47L 15/22* (2013.01)

(58) Field of Classification Search
CPC ..... A47L 15/0086; A47L 15/14; A47L 15/18; A47L 15/22; A47L 15/23; A47L 15/4214;
(Continued)

(56) References Cited

U.S. PATENT DOCUMENTS 3,312,232 A * 4/1967 Jenkins ..... A47L 15/23 134/176
5,131,432 A * 7/1992 Santarossa ..... A47L 15/4223 134/183

(Continued)

FOREIGN PATENT DOCUMENTS

DE 20113227 U1 * 10/2001 ..... A47L 15/23
JP 2006095001 A * 4/2006

OTHER PUBLICATIONS

Machine Translation of Okazaki et al., JP-2006095001-A, Apr. 2006. (Year: 2006).*
Machine Translation of DE-20113227-U1, Oct. 2001. (Year: 2001).*

*Primary Examiner* — David G Cormier
(74) *Attorney, Agent, or Firm* — Wang Law Firm, Inc.

(57) ABSTRACT

A rotary spray arm for a washing device and a washing device, the rotary spray arm comprises a pair of an upper cover and a lower cover attached to the upper cover; a flow channel disposed between the upper cover and the lower cover, the water outlets are disposed on the upper cover; an upper chamber in communication with the flow channel is formed at a center of the lower cover; the flow channel is located at two sides of the upper chamber, and a hole matching to the upper chamber is formed on a bottom surface of the lower cover. The rotary spray arm is provided with a chamber for accommodating the water outlet portion of the water pump and the chamber is communicated to the water outlets, therefore, the rotary spray arm can be manu-
(Continued)

factured independently of the water pump, and both processing and mounting are very convenient.

8 Claims, 5 Drawing Sheets

(58) Field of Classification Search
CPC ..... A47L 15/4219; A47L 15/4225; A47L 15/4278; A47L 15/428; A47L 15/4282; A47L 15/4289
See application file for complete search history.

(56) References Cited

U.S. PATENT DOCUMENTS 5,470,142 A * 11/1995 Sargeant ..... A47L 15/0084 312/258
2014/0069472 A1* 3/2014 Lee ..... A47L 15/428 134/174

* cited by examiner

ROTATING SPRAY WALL USED IN WASHING APPARTUS AND APPLICATION THEREOF

RELATE APPLICATIONS

This application is a national phase entrance of and claims benefit to PCT Application for a rotary spray arm for a washing device and application thereof, PCT/CN2014/001153, filed on Dec. 22, 2014, which claims benefit to Chinese Patent Applications 201310752116.6, filed on Dec. 31, 2013. The specifications of both applications are incorporated here by this reference.

FIELD OF THE INVENTION

The present invention relates to a washing device, and in particular to a rotary spray arm for the washing device and a sink-type washing device with this rotary spray arm.

DESCRIPTION OF THE PRIOR ART

Dishwasher is a device which sprays cold water or hot water onto dishes to remove dirt on the dishes and washes the dishes. The dishes are placed in a dish shelve inside a dishwasher cabinet. A dishwasher generally includes a pump and a sprayer both for spraying washing water, a heater for generating hot water, and the like. For the existing dishwashers, steam has been used for washing dishes. Compared with the heated water, the use of steam also reduces the time required for washing and improves the efficiency of washing.

In order to save the space occupied by the dishwasher, many present sink-type washing machines are obtained by slightly refitting on the basis of the existing household sinks. For example, in Chinese Patent Applications CN102940475A and CN102697436A (Application No. 201210374569.5 and 201210157913.5, respectively), an existing process of refitting an existing sink into a washing machine is shown. Particularly in the washing machine disclosed in CN102940475A, a rotary spray arm on the bottom of the sink is mentioned. Such a rotary spray arm is usually connected with a pump which is driven by a motor. The rotary spray arm is fed with a water flow for washing, when the pump is driven by the motor.

Such a structure provides for good washing effect. However, a number of components are required and the structure is thus complicated; and the rotary spray arm needs to be firmly connected to the pump and the motor, the pump and the motor need to be tightly connected to each other, and the pump and the motor also need to be tightly connected to the sink. In this way, objects in the washing machine can be effectively cleaned. Therefore, it is often difficult to disassemble and assemble such rotary spray arm structures, and some such rotary spray arm structures even have to be fixed to ensure that the rotary spray arm will not be loosened to influence the rotary washing effect. Thus, such washing machines still lead to inconvenient use.

SUMMARY OF THE INVENTION

A first technical problem to be solved by the present invention is, in view of the prior art, to provide a rotary spray arm for a washing device, which is convenient for disassembly and assembly.

A second technical problem to be solved by the present invention is to provide a rotary spray arm for a washing device, the rotating speed of which can be adjustable.

A third technical problem to be solved by the present invention is to provide a washing device with the rotary spray arm.

To solve the first technical problem of the present invention, the rotary spray arm for a washing device comprises a plurality of water outlets formed on the top surface of the rotary spray arm; the rotary spray arm with two ends comprises, an upper cover; a lower cover attached to the upper cover; a flow channel disposed between the upper cover and the lower cover; a plurality of water outlets formed on the upper cover, the plurality of water outlets being in communication with the flow channel; an upper chamber formed inside the rotary spray arm at a center of the lower cover and in communication with the flow channel, wherein the flow channel is located at two sides of the upper chamber, and a hole matching to the upper chamber is formed on a bottom surface of the lower cover.

The upper chamber and the hole are used for accommodating the water outlet portion of a water pump, which pumps water into the rotary spray arm.

To allow the pumped water to be sprayed from the rotary spray arm, preferably, a plurality of barriers are provided between the upper cover and the lower cover, the barriers surround the hole to form the upper chamber, and the barriers are respectively extended toward the two ends of the rotary spray arm in a curved shape to form the flow channel. Therefore, the pumped water can be sprayed from the flow channel out of the water outlets.

Preferably, the ratio between a total area of water outlets at two ends of the rotary spray arm and a total area of all the water outlets on the rotary spray arm is between 0.05 and 2.

To make the structure of the rotary spray arm and the water pump stable, preferably, a rotary connecting ring connected to a supporting component is disposed under the rotary spray arm, the rotary connecting ring comprises a clasping ring attached to the lower cover, a plurality of little blocks protruding along the radial direction and matching with the supporting component are provided at an inner circumferential surface of the clasping ring.

Preferably, the clasping ring is detachably connected to the lower cover.

Various existing processes may be used for the detachable connection of the clasping ring with the lower cover. Preferably, the connecting ring further comprises a detachable connection structure between the clasping ring and the lower cover; the detachable connection structure further comprises a fixed ring protruding downward from the bottom surface of the lower cover at a position corresponding to the upper chamber, a plurality of elastic clasps are distributed around a periphery of the fixed ring, and a step portion for engaging the elastic clasps extends from the inner circumferential surface of the clasping ring.

To further solve the second technical problem of the present invention, the rotary spray arm can be controlled at an appropriate rotating speed to obtain good spraying effect. Two counterweights for adjusting the rotating speed of the rotary spray arm are symmetrically disposed on the two ends of the bottom surface of the lower cover, so that the rotating speed of the rotary spray arm can be adjusted by changing the weight of the counterweights.

Preferably, the counterweights are detachably connected to the lower cover. For example, the counterweights are attached to the lower cover by gluing, so that the counterweights can be replaced conveniently.

In order to solve the third technical problem, the washing device comprises a case having a washing space; wherein the washing device further comprises a water pump and the rotary spray arm as described above; the case comprises a sink body having the washing space and a bottom portion, and a cover plate rotatably connected on the sink body; the water pump is disposed in the bottom portion of the sink body and the rotary spray arm is covered on the water pump, and the water pump is disposed inside the upper chamber and the hole of the lower cover.

Preferably, the water pump is an open water pump. The structure of the water pump is simplified so that the manufacturing process of the water pump is simple. The water pump is an open water pump, the water pump comprises an impeller with a center and a guide bracket with a center, the impeller includes a hollow shaft in the center and engaged to an output shaft of a motor and a plurality of blades arranged on the periphery of the shaft, the guide bracket has a lower chamber formed in the center of the guide bracket for accommodating a lower part of each blade, a gap is formed between a bottom of the guide bracket and the bottom portion of the sink body.

Preferably, when the rotary spray arm comprises a rotary connecting ring with a plurality of little blocks, the guide bracket has a plurality of holder matching to the little blocks distributed around the lower chamber, each holder has an opening for receiving a little block, so that the rotary spray arm and the guide bracket are detachably connected with each other.

Compared with the prior art, the present invention has the following advantages: the rotary spray arm is provided with a chamber for accommodating the water outlet portion of the water pump and the chamber is communicated to the water outlets of the rotary spray arm, therefore, the rotary spray arm can be manufactured independently of the water pump, and both processing and mounting are very convenient; the arrangement of counterweights on the rotary spray arm or the adjustment of the area of the water outlets can allow the rotary spray arm to rotate at an appropriate speed to obtain good spraying effect; the arrangement of a connection member detachably connected to the supporting component makes the structure of the rotary spray arm and the water pump more stable.

DETAILED DESCRIPTION OF THE PREFERRED EMBODIMENT

Figure 1:
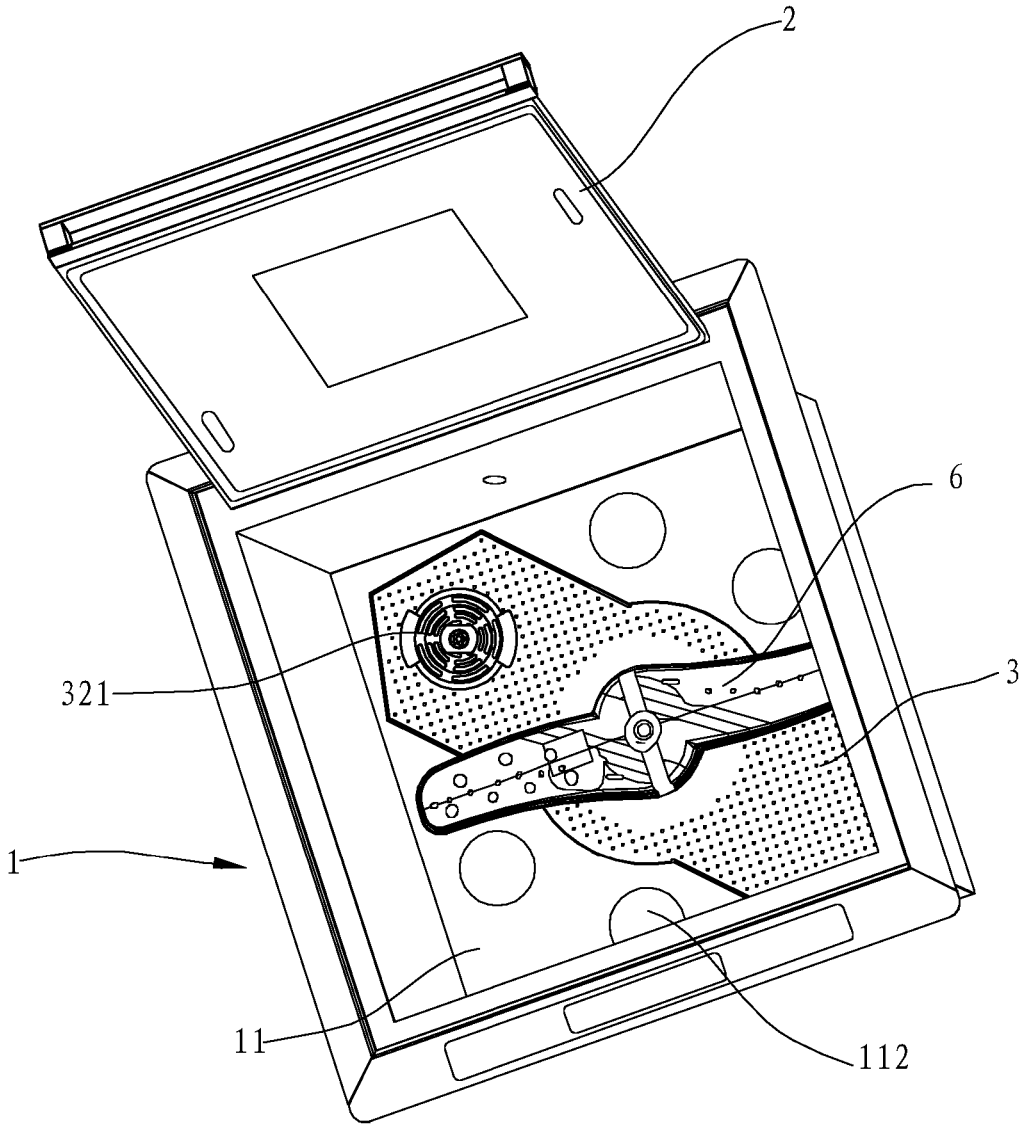
FIG. 1 is a perspective view of a sink-type washing device according to an embodiment of the present invention.
Figure 2:
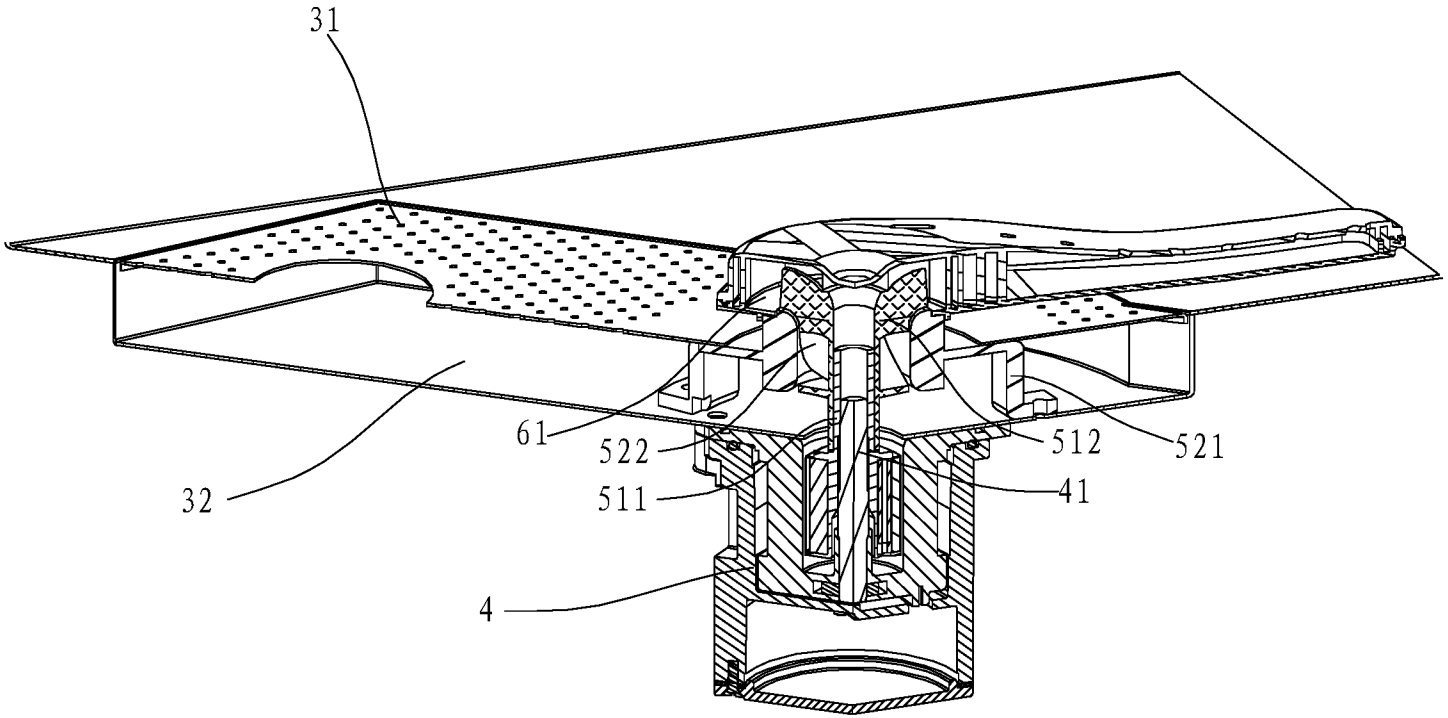
FIG. 2 is a partial cutaway view of the sink-type washing device according to the embodiment of the present invention.
Figure 3:
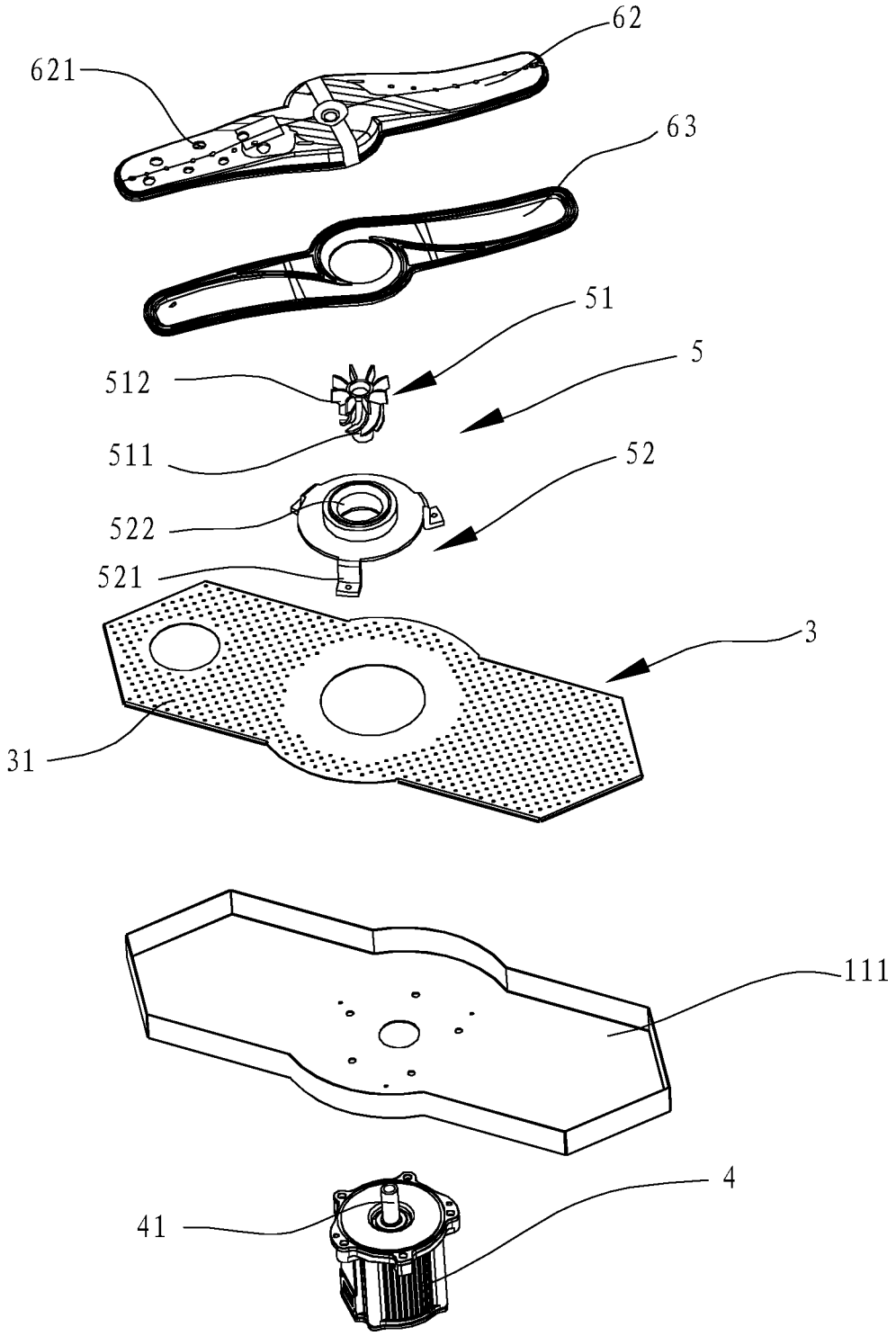
FIG. 3 is an exploded view of partial of the sink-type washing device according to the embodiment of the present invention (the cover plate and the sink body are omitted)

To enable a further understanding of the present invention content of the invention herein, refer to the detailed description of the invention and the accompanying drawings below:

FIG. 1-FIG. 3 show a preferred embodiment of a sink-type washing device of the present invention. The sink-type washing device can be used for washing dishes, vegetables, fruits and the like. The sink-type washing device comprises a sink body 1, a cover plate 2 rotatably connected to the top of the sink body 1, a drain board 3, a water pump 5 and a rotary spray arm 6. The sink body 1 can be a common household sink. A washing space is formed between the sink body 1 and the cover plate 2, to accommodate the dishes, vegetables, fruits and the like, for a purpose of washing them.

The sink body 1 has a bottom board 11 and a recess at least at a center of the bottom board 11. The drain board 3 having a same shape as the recess is covered over the recess of the bottom board 11, the recess under the drain board 3 forms a drain region 32. The drain board 3 with a plurality of drain holes 31 for drainage. A surface of the drain board 3 is flushed with the bottom board 11 of the sink body 1 around the drain board 3. Alternatively, in this embodiment, as shown in FIG. 3, the drain region 32 is formed by a box 111, in detail, the bottom board 11 has a hole and a box 111 is disposed under the hole of the bottom board 11, the drain board 3 covers the box 111 and is flushed with other portions of the bottom board 11, a space inside the box 111 forms the drain region 32. Alternatively, the drain region 32 can be formed as below: the drain board 3 can have a same shape and size as the bottom board 11, and can be entirely located above and spaced apart from the bottom board 11, then a space between the drain board 3 and the bottom board 11 forms the drain region 32.

On the outside of the sink body 1, a motor 4 with an output shaft 41 is provided below the bottom board 11. The output shaft 41 of the motor 4 is inserted into the sink body 1 and located in the drain region 32 above the bottom board 11, or, in this embodiment, as shown in FIG. 3, when a box 111 is used, the output shaft 41 of the motor 4 is inserted into the box 111.

A residue basket 321 is also disposed in the drain region 32. The top of the residue basket 321 is slightly higher than the drain board 3. The residue basket 321 is used for holding residues left after the washing, in order to avoid blocking a water drain pipe in communication with the residue basket 321. An ultrasonic generator 112 is disposed on the bottom board 11 around the drain board 3.

The water pump 5 is disposed within the drain region 32. In this embodiment, the water pump 5 is an open water pump. The water pump 5 includes an impeller 51 and a guide bracket 52. The impeller 51 includes a hollow shaft 511 in the center and a plurality of blades 512 arranged on the circumferential surface of the shaft 511. The blades 512 are evenly distributed on the circumferential surface of the shaft 511 and extended in an axial direction. A lower end of the shaft 511 is connected to an output shaft 41 of the motor 4, and in this way, the impeller 51 can be driven to rotate when the motor 4 rotates.

The guide bracket 52 is provided outside the impeller 51. A plurality of mounting feet 521 are provided circumferentially on the guide bracket 52. The mounting feet 521 can be fixed to the bottom board 11, the box or the motor 4 by screws or the like. There is a gap between a bottom surface of the guide bracket 52 and a bottom surface of the drain region 32, and the water inside the drain region 32 flows through the gap. The lower part of each blade 512 is located within a lower chamber 522 formed in the center of the guide bracket 52, and the upper part of each blade 512 is exposed out of the guide bracket 52.

The rotary spray arm 6 is supported by a step on the top of the guide bracket 52, and located above the drain board 3. An upper chamber 61, for accommodating an upper portion of each of the blades 512, is formed on the bottom of the middle portion of the rotary spray arm 6. The rotary spray arm 6 is supported on a portion of the guide bracket 52 around the lower chamber 522. The guide bracket 52 supports the rotary spray arm 6. The lower chamber 522 of the guide bracket 52 and the impeller 51 form the above said water pump 5. The blades 512 can lift the water in the drain region 32 and pump it into the rotary spray arm 6 from the upper chamber 61, to wash objects to be washed (dishes, vegetables, fruits and the like).

The rotary spray arm 6 includes an upper cover 62 and a lower cover 63. A flow channel 64 inside the rotary spray arm 6 communicated to the upper chamber 61 is formed between the upper cover 62 and the lower cover 63, the upper chamber 61 is located in the middle of the rotary spray arm 6, and the flow channel 64 is located at the two sides of the upper chamber 61. A plurality of water outlets 621 are formed on an upper surface of the upper cover 62. The water outlets 621 are located above the flow channel 64 and at a position corresponding to the flow channel 64. The water pumped by the water pump 5 enters into the flow channel 64 from the upper chamber 61, and is then sprayed from the water outlets 621 to wash the objects to be washed. Preferably, a ratio between a total area of water outlets 621 at two ends of the upper cover 62 and a total area of all the water outlets 621 on the upper cover 62 is between 0.05 and 2, more preferably is ⅓. The greater the ratio is, the higher the rotating speed of the rotary spray arm 6 is. Therefore, the rotary spray arm 6 is adjusted to a desired speed to obtain better spraying effect.

Figure 4:
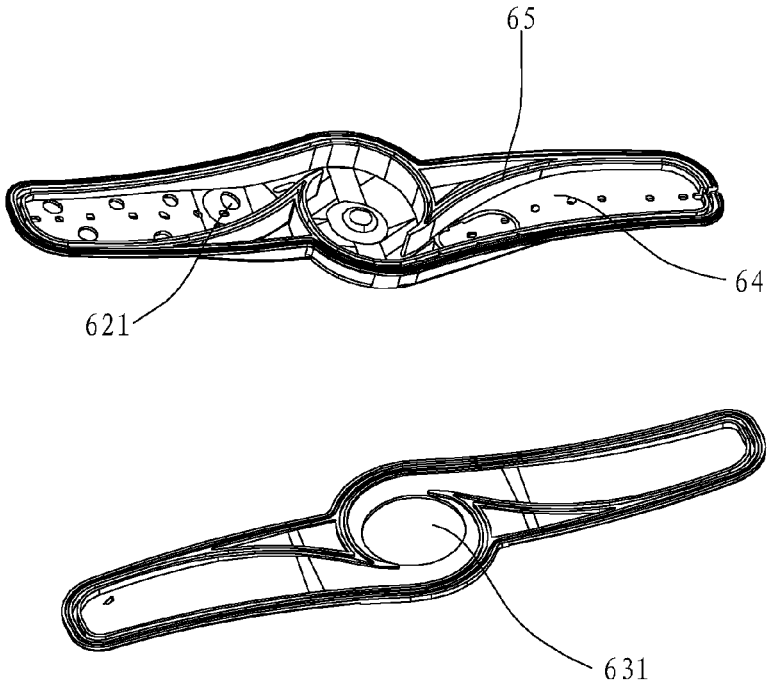
FIG. 4 is an exploded view of a rotary spray arm according to the embodiment of the present invention.

The upper cover 62 has two barriers 65 each extending from an inner surface of the upper cover 62 toward the lower cover 63. As shown in FIG. 4, a hole 631 is formed on the middle of the bottom of the lower cover 63. Two barriers 65 surround the hole 631 to form the upper chamber 61, and each barrier 65 respectively extends along the lengthways of the rotary spray arm 6 toward the end of the rotary spray arm 6 from the position of the hole 631 in a curved shape to form the flow channel 64, accordingly, the flow channel 64 inside the rotary spray arm 6 is isolated between the upper cover 62 and the lower cover 63. The design of the flow channel 64 allows the rotary spray arm 6 to rotate in a single direction under the pressure of water flowing from the upper portion of the impeller 51, and thus allows the water outlets 621 to spray a water flow to wash dishes, vegetables and the like in the sink body 1. Alternatively, the barriers 65 can be disposed on the lower cover 63 and extended toward the upper cover 62, as long as they are located between the upper cover 62 and the lower cover 63. A side wall of the upper chamber 61 can be circular, or can be in other shapes.

Or, a connection member, which is convenient for detachable cooperation, can be provided between the rotary spray arm 6 and the guide bracket 52, so that the structure of the rotary spray arm 6, the impeller 51 and the guide bracket 52 becomes more reliable and stable.

Figure 5:
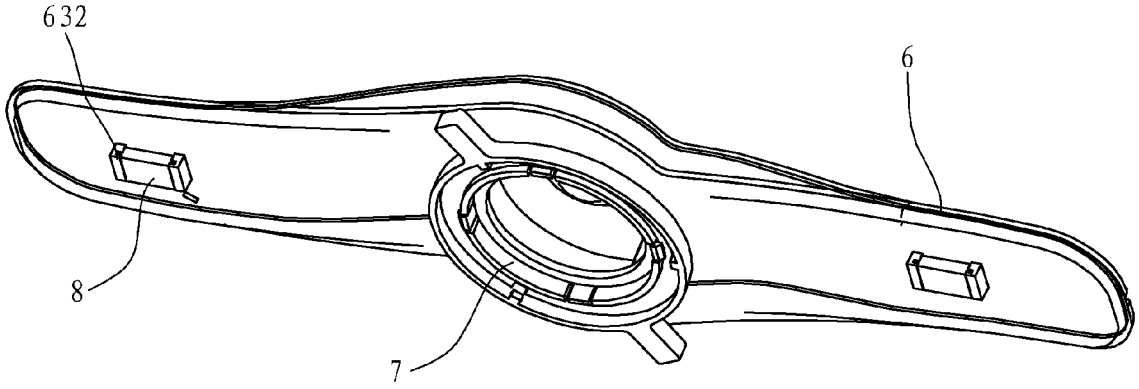
FIG. 5 is a perspective view of a rotary spray arm according to another embodiment of the present invention.
Figure 6:
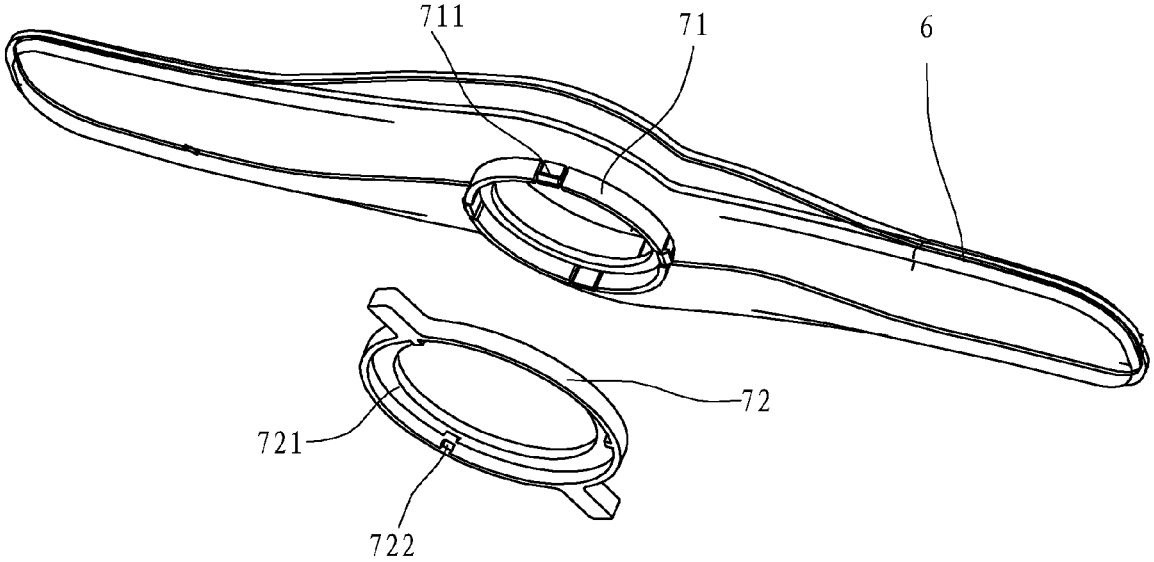
FIG. 6 is an exploded view of a rotary connecting ring of FIG. 5.
Figure 7:
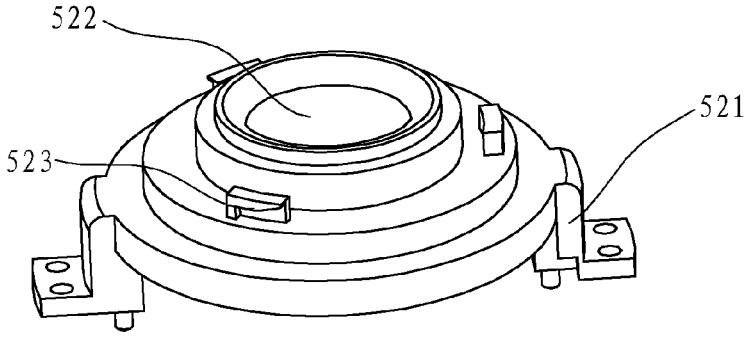
FIG. 7 is a perspective view of a guide bracket corresponding to the rotary spray arm of FIG. 5.

FIG. 5-FIG. 7 show a rotary spray arm in a sink-type washing device of another embodiment. In this embodiment, the rotary spray arm 6 and the guide bracket 52 are connected with each other by a rotary connecting ring 7. The rotary connecting ring 7 comprises a fixed ring 71 protruding downward from the bottom surface of the lower cover 63 of the rotary spray arm 6 at a position corresponding to the upper chamber 61, and a clasping ring 72. A plurality of elastic clasps 711 are distributed around a periphery of the fixed ring 71 arranged, and a step portion 721 for engaging the elastic clasps 711 extends from the inner circumferential surface of the clasping ring 72. After the clasping ring 72 is attached on the fixed ring 71, the elastic clasps 711 are all positioned at the bottom surface of the step portion 721 to make the clasping ring 72 reliably attached with the fixed ring 71.

A plurality of little blocks 722 protruding along the radial direction are provided at the inner circumferential surface of the clasping ring 72, and the guide bracket 52 has a plurality of holder 523 matching to the little block 722 distributed around the lower chamber 522. Each holder 523 has an opening for receiving a little block 722 formed at one side of the holder 523. By rotating the clasping ring 72 to make the little block 722 close to the holder 523 and allow each little block 722 to insert into the opening of each corresponding holder 523, then each little block 722 is positioned and clamped in the holder 523, finally, the rotary spray arm 6 and the guide bracket 52 can be connected firmly with each other.

Two counterweights 8 are symmetrically disposed on the two ends of the bottom surface of the lower cover 63. The counterweights 8 can be positioned with the lower cover 63 or directly fixed with the lower cover 63 by gluing, or connected with the lower cover 63 in other ways. In the embodiment, the counterweights 8 are connected on the low cover 63 by means of clamping: a fastener 632 is provided on each side of the lower surface of the lower cover 63; the fastener 632 has a space for accommodating the counterweights 8 in the middle; and guide grooves may be formed on inner sides of the two sides of the fastener 632 and guide ridges are correspondingly provided on outer sides of the two sides of the counterweights 8 to be fitted with the guide grooves, so that the counterweights 8 can move along the guide grooves to be fixed to the fastener 632 by means of clamping. The rotating speed of the rotary spray arm 6 can be adjusted by changing the weight of the counterweights 8.

Alternatively, the water pump can also be a frequently-used closed water pump of a closed structure. Water inside the drain region 32 is drawn into the closed water pump and then pumped into the rotary spray arm 6 from the water outlets. That is, the rotary spray arm 6 still serves as the water outlet component of the closed water pump. The upper chamber 61 of the rotary spray arm 6 can accommodate the water outlets of the water pump.

The operating process of the sink-type washing device of the present invention will be described below. Taking dish washing as an example, first, a dish shelve is put into the sink body 1, dishes to be washed are placed on the dish shelve, and then the cover plate 2 is covered; a certain amount of clean water is poured into the sink body 1, and the clean water enters the drain region 32; the motor 4 is started to drive the impeller 51 to rotate; with the rotation of the impeller 51, water in the drain region 32 flows upward into the upper chamber 61 from the lower part of the impeller 51, enters into the flow channel 64 from the side of the upper chamber 61, and is sprayed out through the water outlets 621 on the upper cover 62 at a position corresponding to the flow channel 64; and meanwhile, the rotary spray arm 6 rotates under the driving of the water flow to spray water and wash the dishes.

After cleaning, water enters into the drain region 32 again from the drain board 3 and can be reused by the impeller 51. The drain board 3 can allow water to pass through, and also can keep large residues above the drain board 3 to prevent them from entering the drain region 32 and further the impeller 51 to effect the normal rotation of the impeller 51.

Such a structure is both water and energy saving and good in washing effect. Furthermore, it can be obtained by refitting a household sink. Since the sink body can be any household sink, the cost is saved, and the space of the kitchen is saved. When the function of the washing device is not to be used, the rotary spray arm 6 is taken down, the impeller 51 and the guide bracket 52 are detached, and the drain board 3 is returned to the original position. In this way, the washing device is returned to a common sink.

The invention claimed is:

1. A rotary spray arm with a top surface and two ends for a washing device comprising:

an upper cover;

a lower cover attached to the upper cover;

a flow channel disposed between the upper cover and the lower cover;

a plurality of water outlets formed on the upper cover, the plurality of water outlets being in communication with the flow channel;

an upper chamber formed inside the rotary spray arm at a center of the lower cover and in communication with the flow channel, wherein the flow channel is located at two sides of the upper chamber, and a hole matching to the upper chamber is formed on a bottom surface of the lower cover, and a rotary connecting ring connected to a supporting component is disposed under the rotary spray arm, the rotary connecting ring comprises a clasping ring attached to the lower cover, and a plurality of blocks protruding from an inner circumferential surface of the clasping ring, the rotary connecting ring further comprises a detachable connection structure between the clasping ring and the lower cover, the detachable connection structure further comprises a fixed ring protruding downward from the bottom surface of the lower cover at a position corresponding to the upper chamber, a plurality of elastic clasps are distributed around a periphery of the fixed ring, and a step portion for engaging the elastic clasps extends from the inner circumferential surface of the clasping ring.

2. The rotary spray arm of claim 1, wherein, a plurality of barriers are provided between the upper cover and the lower cover, the barriers surround the hole to form the upper chamber, and the barriers are respectively extended toward the two ends of the rotary spray arm in a curved shape to form the flow channel.

3. The rotary spray arm of claim 1, wherein, the clasping ring is detachably connected to the lower cover.

4. The rotary spray arm of claim 1, wherein, two counterweights for adjusting the rotating speed of the rotary spray arm are symmetrically disposed on the bottom surface of the lower cover.

5. The rotary spray arm of claim 1, wherein, counterweights are attached to the lower cover by gluing.

6. A washing device, comprising a case having a washing space;

wherein, the washing device further comprises a water pump and the rotary spray arm of claim 1;

the case comprises a sink body having the washing space and a bottom portion, and a cover plate rotatably connected on the sink body;

the water pump is disposed in the bottom portion of the sink body and the rotary spray arm is covered on the water pump, and the water pump is disposed inside the upper chamber and the hole of the lower cover.

7. The washing device of claim 6, wherein, the water pump is an open water pump, the water pump comprises an impeller with a center and a guide bracket with a center, the impeller includes a hollow shaft in the center of the impeller and engaged to an output shaft of a motor and a plurality of blades arranged on a periphery of the hollow shaft, the guide bracket has a lower chamber formed in the center of the guide bracket for accommodating a lower part of each blade, a gap is formed between a bottom of the guide bracket and the bottom portion of the sink body.

8. The washing device of claim 7, wherein, the rotary spray arm comprises the rotary connecting ring with the plurality of blocks, the guide bracket has a plurality of holders for receiving the plurality of blocks distributed around the lower chamber, each holder has an opening for receiving a block.

* * * * *